US005087800A

United States Patent [19]

Gesche et al.

[11] Patent Number: 5,087,800

[45] Date of Patent: Feb. 11, 1992

[54] HIGH FREQUENCY, LARGE CURRENT, SWITCH INCLUDING A PRESSURE-ACTUATED CURRENT-CARRYING EXTENSIBLE BELLOWS ELEMENT

[75] Inventors: Roland Gesche, Seligenstadt; Stefan Locher, Alzenau, both of Fed. Rep. of Germany

[73] Assignee: Leybold Aktiengesellschaft, Hanau, Fed. Rep. of Germany

[21] Appl. No.: 642,704

[22] Filed: Jan. 17, 1991

Related U.S. Application Data

[63] Continuation of Ser. No. 408,251, Sep. 18, 1989, abandoned.

[30] Foreign Application Priority Data

Jul. 18, 1989 [DE] Fed. Rep. of Germany ..... 3923660

[51] Int. Cl.[5] ..... H01H 35/32

[52] U.S. Cl. ..... 200/83 C; 73/729; 200/83 N

[58] Field of Search ..... 73/723, 729; 340/626; 307/118; 200/81 R, 81.8, 82 R, 82 B, 83 R, 83 C, 83 N, 83 J, 83 W

[56] References Cited

U.S. PATENT DOCUMENTS

| | | | |
|---|---|---|---|
| 2,697,764 | 12/1954 | Burlingham | 200/83 C |
| 2,794,087 | 5/1957 | Jennings et al. | 200/82 R |
| 2,997,671 | 8/1961 | Rueggeberg | 333/17 |
| 3,046,369 | 7/1962 | Hicks | 200/83 C |
| 3,532,842 | 10/1970 | Fohrhaltz | 200/83 C |
| 3,904,842 | 9/1975 | Gauer | 200/83 C |
| 3,950,628 | 4/1976 | Hruda | 200/83 C |
| 4,207,137 | 6/1980 | Tretola | 156/627 |
| 4,633,213 | 12/1986 | Venena | 340/60 |
| 4,697,643 | 10/1987 | Sassier | 169/23 |

FOREIGN PATENT DOCUMENTS

| | | | |
|---|---|---|---|
| 754566 | 1/1951 | Fed. Rep. of Germany . | |
| 1965771 | 6/1967 | Fed. Rep. of Germany . | |
| 3314514 | 4/1983 | Fed. Rep. of Germany . | |
| 8430787 | 10/1984 | Fed. Rep. of Germany . | |
| 3501603 | 1/1985 | Fed. Rep. of Germany . | |
| 3718304 | 5/1987 | Fed. Rep. of Germany . | |
| 3815107 | 4/1988 | Fed. Rep. of Germany . | |
| 3909321 | 3/1989 | Fed. Rep. of Germany . | |
| 882291 | 5/1942 | France . | |
| 1317246 | 12/1961 | France . | |
| 1035664 | 8/1983 | Switzerland | 200/83 C |
| 637121 | 7/1948 | United Kingdom . | |

OTHER PUBLICATIONS

W. van den Hoek et al., "Power Loss Mechanisms in Radio Frequency Dry Etching Systems", J. Vac. Sci. Technol. B 5 May/Jun 1987, pp. 647-651.

F. Vratny, "Deposition of Tantalum and Tantalum Oxide by Superimposed RF and D-C Sputtering", J. Electrochem Soc. Solid-State Science (May 1967), pp. 505-508.

*Primary Examiner*—Gerald P. Tolin

*Attorney, Agent, or Firm*—Lowe, Price, LeBlanc & Becker

[57] ABSTRACT

The invention concerns an on-off switch (1) for high-frequency currents. This switch (1) comprises a housing (2) made of an electrically non-conducting plastic and sealed at both its upper and its lower sides by electrically conducting contact parts (3,4). A metal bellows (14) is present in the housing (2) and is connected at one end to one of the contact parts, (4) and at its other end to a contact head (25). Using compressed air, the contact head (25) can be moved to make contact with the other contact part (3) or be removed away from it.

23 Claims, 2 Drawing Sheets

HIGH FREQUENCY, LARGE CURRENT, SWITCH INCLUDING A PRESSURE-ACTUATED CURRENT-CARRYING EXTENSIBLE BELLOWS ELEMENT

This application is a continuation of application Ser. No. 07/408,251 filed Sept. 18, 1989, and now abandoned.

TECHNICAL FIELD OF THE INVENTION

The invention concerns an on-off switch used in high frequency, high power circuits.

BACKGROUND OF THE PRIOR ART

High frequency plasma generation is widely used in equipment for depositing or removing thin films. Typically, the high frequency is 13.56 MHz, with the applied currents going up to 50 A. To be able to switch such high currents, the switches must meet special requirements. Illustratively, one such requirement is an arcing resistance of 10 kv when open.

Several examples of high-frequency equipments are already known which are fitted with electrodes to which high-frequency power is applied (J. Electrochem. Soc. Solid State Science, vol. 114, #5, 1967, pp 505–8); U.S. Pat. No. 4,207,137; J. Vac. Sci. Technol. vol. 5, #3, 1987, pp 647–51), however no switches are being described therein whereby large, high-frequency currents are switched onto or off an electrode.

DISCLOSURE OF THE INVENTION

Accordingly, it is the object of the present invention to create an on-off switch permitting to a user to switch large, high-frequency currents.

The advantage achieved by the invention in particular is that the surface current caused by the skin effect is presented with a large conducting surface in the form of a metal bellows. The metal components, for instance the return spring, are screened by this metal bellows and therefore are shielded from the high electromagnetic field intensities. Because the metal bellows combines the functions of an electrical conductor and of a pneumatic cylinder, the switch can be made compact. The plane contact surfaces allow a small stroke and represent an advantageous transition surface for the surface currents.

BRIEF DESCRIPTION OF DRAWINGS

The drawing shows illustrative embodiments of the invention which are described in further detail below.

BEST MODE FOR PRACTICING THE INVENTION

Figure 1:
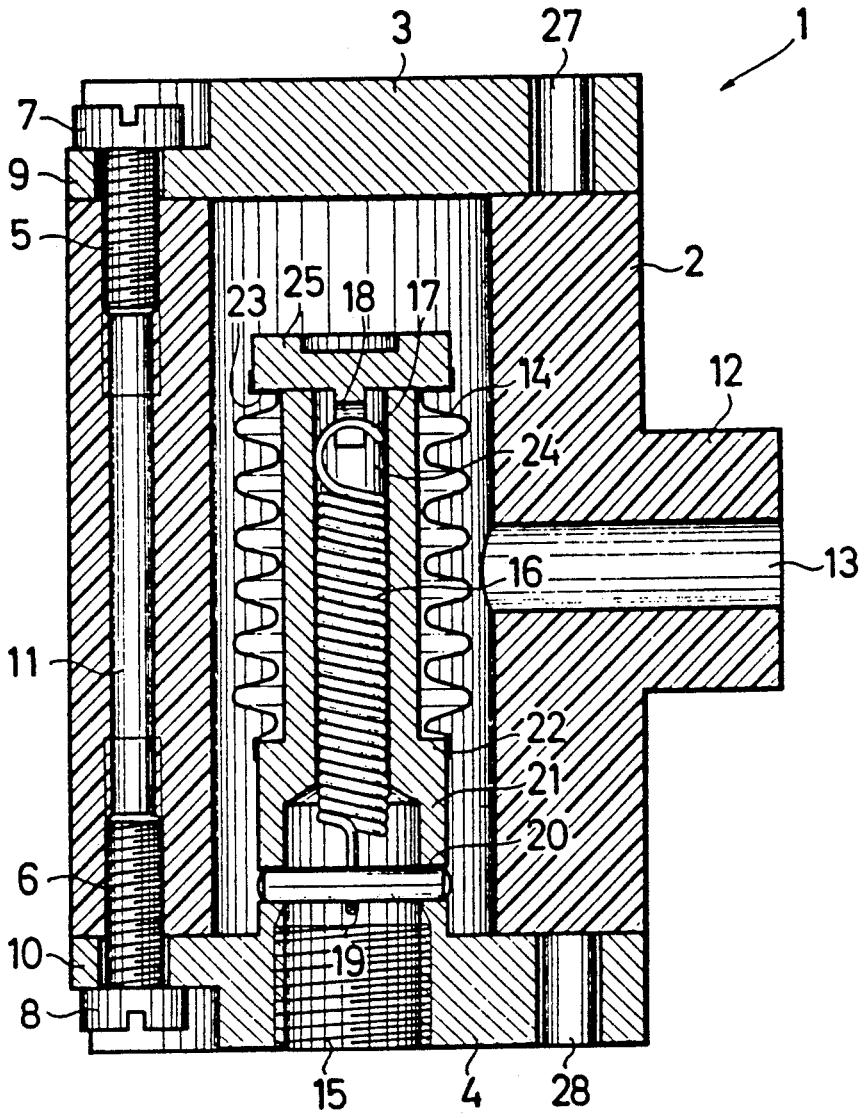
FIG. 1 is a first embodiment of a switch for switching large, high-frequency currents.

FIG. 1 shows a first embodiment of a pneumatically driven switch 1 comprising an electrically insulating housing 2 and equipped with electrically conducting contact parts 3,4 at the top and bottom. The contact parts 3,4 are solidly joined by electrically insulating screws 5,6 to the housing 2, said screws resting by their heads 7,8 on the particular projections 9,10 of the contact parts 3,4. The screws 5,6 are screwed into a screw duct 11 of the housing 2. The housing 2 proper is illustratively cylindrical and, opposite the screw duct 11, comprises a stub 12 with bore 13. An electrically conducting metal bellows 14 is present inside the housing 2 and is fed with compressed air at its intake 15. The compressed air acts against the force of a spring 16 suspended at one of its ends 17 from a hook 18 and of which the other end 19 is suspended from a crosspin 20 resting in a vertical extension 21 of the contact part 4. Essentially this extension 21 of the contact part assumes the shape of a hollow cylindrical pin with two end setups 22,23 serving as supports for the lower and upper ends of the metal bellows 14. However the lower end stop 22 is not integrally joined to the extension 21 but, instead, resting on it.

If compressed air is now supplied to the intake 15, it will arrive in the cavity 24 of the extension which also houses the spring 16 and will press against the lower side of a contact element 25 connected by its lateral edge to the metal bellows 14. If the force exerted by the compressed air is larger than that of the spring 16, then the metal bellows 14 will extend until the contact element 25 hits the lower surface of contact part 3. Electrical contact is thereby set up between the contact parts 3 and 4 and current can flow between the contact part 3 through the metal bellows 14 and the extension 21 to the contact part 4 and vice-versa. If the compressed air flow should become less or stops entirely, then the force of the spring 16 will prevail and contact element 25 is returned back to the position shown in FIG. 1.

The bore 13 provides a pressure balance inside the housing 2. If the housing 2 were always sealed hermetically, the metal bellows 14 would have to compress the air inside the housing by means of the contact element 25 in order that this contact element 25 should arrive at the contact part 3. The housing 2 comprises further bores 27, 28 above and below the bore 13 to admit high-frequency guides, as rule strips. The bores 27, 28 also may be threaded.

Figure 2:
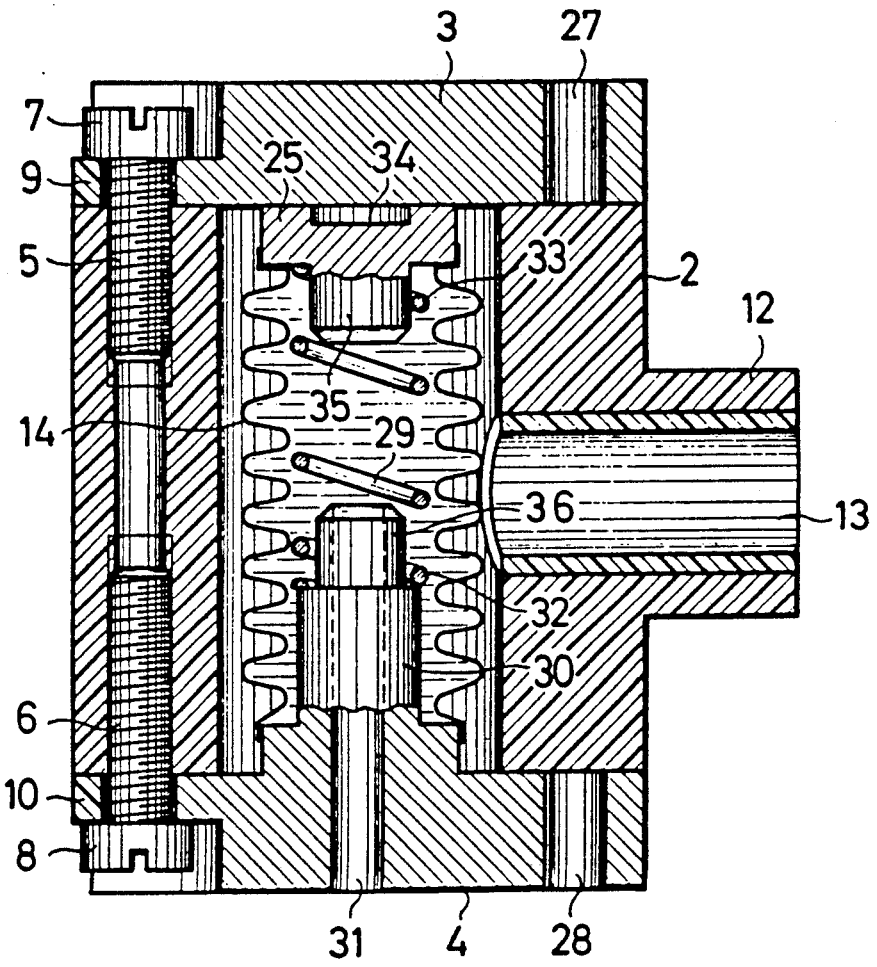
FIG. 2 is a second embodiment of a switch for switching large, high-frequency currents.

FIG. 2 shows a further embodiment of the invention, wherein those components also present in the system of FIG. 1 are denoted by the same reference numerals. Contrary to the first embodiment the embodiment of FIG. 2 is without a tension spring pulling down the contact surface 25 and being stretched by the incoming compressed air, but instead comprises an outwardly acting compression spring 29. This compression spring 29 is surrounded by a metal bellows 14 and rests by one of its ends on a projection 30 integral with the contact part 4 and comprising a bore 31. The projection 30 ends at its top in a narrower part 36 guiding one end 32 of the spring 29. The other end 33 of the spring 29 is guided in similar manner by a narrow part 35 merging into the contact surface 25. The contact parts 3 and 4 are making electrical contact through the metal bellows 14 in the absence of compressed air because the spring 29 permanently forces the contact element 25 against contact part 4. If, however, compressed air is admitted into the space between the metal bellows 14 and the housing 2 through the opening 13, then this compressed air will pass through a bore to a surface 34 of the contact element 25 which then is forced down.

The function of the bore 31 is the same as that of the bore 13 in FIG. 1, namely it balances the pressure inside the housing. Essentially the difference between the switch of FIG. 1 and that of FIG. 2 is that the switch of FIG. 1 is open when un-pressurized whereas the switch of FIG. 2 is closed against the force of the tension or compressing spring, respectively. The spring force exerted by the bellows assumes only minor significance.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

We claim:

1. An on-off switch, especially suitable for switching large, high-frequency currents, comprising:

(a) two non-deforming contact parts, maintained a predetermined distance apart, which are to be electrically connected;

(b) an insulator extending between the contact parts, electrically insulating them from each other and comprising a cavity, the respective ends of said insulator being in physical contact with said contact parts; and (c) an electrically conducting bellows disposed within the cavity, said bellows having a fixed end attached to one of said contact parts and a movable distal end comprising an electrically conducting contact head closing said distal end, whereby in a stretched state said bellows via said contact head is placed in contact with both contact parts to electrically connect the two contact parts to each other without deforming the same and provides an electrical current-carrying path therebetween, said bellows in an unstretched state physically separating said head at its distal end from the corresponding one of the contact parts to break electrically conductive contact between the two contact parts.

2. The on-off switch as defined in claim 1, wherein:

the electrically conducting bellows is operable to change between said stretched and unstretched states by a flow of a pressurized fluid into and out of the bellows, wherein said cavity has a bore formed to enable balancing of pressure between the inside and the outside of the bellows so that the switch is open when said pressure is balanced.

3. The on-off switch as defined in claim 2, wherein:

the pressurized fluid is compressed air.

4. The on-off switch as defined in claim 1, wherein:

a spring is mounted inside the electrically conducting bellows and is connected by its ends to components each connected to form a respective adjacent end of the bellows.

5. The on-off switch as defined in claim 1, wherein:

the insulator forms a housing which is closed at each of two ends by a respective one of said two contact parts.

6. The on-off switch as defined in claim 5, wherein:

the contact parts are connected by screws to the housing.

7. The on-off switch as defined in claim 6, wherein:

the screws are made of an electrically non-conducting material.

8. The on-off switch as defined in claim 4, wherein:

the spring is a tension spring.

9. The on-off switch as defined in claim 4, wherein:

the spring is a compression spring.

10. The on-off switch as defined in claim 1, wherein:

an opening is provided in one of the two contact parts to admit compressed air inside the bellows.

11. The on-off switch as defined in claim 1, wherein:

an opening is provided in the insulator by means of which compressed air is provided to the outside of the bellows to cause the same to change between its stretched and unstretched states.

12. The on-off switch as defined in claim 4, further comprising:

one of said components is an electrical contact head and the other component is a projection of one of said contact parts.

13. The on-off switch as defined in claim 12, wherein:

the spring is a tension spring and is suspended by one of its ends from the contact head and by its other end from a crosspin connected to the projection.

14. The on-off switch as defined in claim 12, wherein:

the spring is a compression spring and encloses by its one end a constriction of the projection and by its other end a constriction of the contact head.

15. An on-off switch, especially suitable for switching large, high-frequency currents, comprising:

(a) two contact parts, maintained a predetermined distance apart by a hollow insulator contacting the same and defining a cavity therebetween, which are to be electrically connected;

(b) an electrically conducting bellows within the cavity, having a base end connected to one of the contact parts and a conducting head forming a closed distal end adjacent the other of said contact parts, which in its stretched state establishes contact between the contact parts via the conducting head and provides an electrical current-carrying path therebetween and which in an unstretched state separates said conducting head at its distal end from the corresponding one of the contact parts to break electrical contact between the two contact parts;

(c) fluid means for providing a force driving the bellows between said unstretched and stretched states; and (d) spring means mounted inside the electrically conducting bellows comprising a spring connected at a first end to said head and connected at a second end to the base at the end of the bellows for providing a counter-force against said force provided by the fluid means, wherein said cavity has a bore formed to enable balancing of pressure between the inside and the outside of the bellows so that the switch is open when said pressure is balanced.

16. The on-off switch according to claim 15, wherein:

the pressurized fluid is compressed air.

17. The on-off switch according to claim 15, wherein:

an opening is provided in one of the two contact parts to admit compressed air inside the bellows.

18. The on-off switch according to claim 15, further comprising:

one of said components is an electrical contact head and the other component is a projection of one of said contact parts.

19. The on-off switch according to claim 18, wherein:

the spring is a tension spring and is suspended by one of its ends from the contact head and by its other end from a crosspin connected to the projection.

20. The on-off switch according to claim 18, wherein:

the spring is a compression spring and encloses by its one end a constriction of the projection and by its other end a constriction of the contact head.

21. An on-off switch, especially suitable for switching large high-frequency currents, comprising:

(a) first and second contact parts, maintained a predetermined distance apart, which are to be electrically connected, said first contact part having a hollow cylindrical extension and a pin extending across therewithin;

(b) an electrically conducting bellows, having a base end connected to said first contact part and a head forming a closed distal end adjacent said second contact part, said bellows in a stretched state extending to establish electrical contact between the contact parts and providing an electrical current-carrying path therebetween and in an unstretched state physically separating said head at its distal end from said second contact part to break electrical contact between the two contact parts, said bellows surrounding and containing the hollow cylindrical extension of said first contact;

(c) fluid means for providing a force driving the bellows between said unstretched and stretched states; and (d) spring means mounted inside said hollow cylindrical extension of said first contact within the electrically conducting bellows, the spring means being connected at a first end to said head and at a second end to said pin for providing a counter-force against said force provided by the fluid means.

22. An on-off switch according to claim 21, further comprising:

an electrically insulating housing defining an internal space and supporting said first contact part and said second contact part, an opening being provided in aid housing to communicate with said internal space therein to facilitate extension of said bellows.

23. An on-off switch, especially suitable for switching large, high-frequency currents, comprising:

(a) an electrically insulating housing defining an internal space for supporting electrical contact parts, said housing being provided with an opening communicating with said internal space through a side wall;

(b) first and second contact parts, maintained a predetermined distance apart by said housing, which are to be electrically connected;

(c) an electrically conducting bellows, having a base end connected to said first contact part and an electrically conducting head forming a closed distal end adjacent said second contact part, said bellows in a stretched state extending to establish electrical contact through the conducting head between the contact parts and providing an electrical current-carrying path therebetween and in an unstretched state physically separating said conducting head at its distal end from said second contact part to break electrical contact between the first and second contact parts;

(d) fluid means for providing pressurized fluid to the bellows to generate a force driving the bellows between said unstretched and stretched states; and (e) spring means mounted inside the electrically conducting bellows and connected at its ends to components each connected to form a respective adjacent end of the bellows, for providing a counter-force against said force provided by the fluid means whereby adjustment of pressure within said internal space is enabled by said opening in the sidewall of the housing and the switch is open when said fluid pressure is balanced.

* * * * *